US010689843B1

(12) United States Patent
Raccuia

(10) Patent No.: US 10,689,843 B1
(45) Date of Patent: Jun. 23, 2020

(54) SHUTTERING FRAMEWORK FOR INSULATED SANDWICH WALLS

(71) Applicant: Joseph Raccuia, Dublin, OH (US)

(72) Inventor: Joseph Raccuia, Dublin, OH (US)

( * ) Notice: Subject to any disclaimer, the term of this patent is extended or adjusted under 35 U.S.C. 154(b) by 0 days.

(21) Appl. No.: 16/576,176

(22) Filed: Sep. 19, 2019

(51) Int. Cl.

| | |
|---|---|
| ***E04B 1/00*** | (2006.01) |
| ***E04B 2/58*** | (2006.01) |
| ***E04C 5/16*** | (2006.01) |
| ***E04B 1/78*** | (2006.01) |
| ***E04B 2/84*** | (2006.01) |

(52) U.S. Cl.
CPC ..... *E04B 2/58* (2013.01); *E04B 1/78* (2013.01); *E04B 2/847* (2013.01); *E04C 5/168* (2013.01)

(58) Field of Classification Search
None
See application file for complete search history.

(56) References Cited

U.S. PATENT DOCUMENTS 3,625,470 A * 12/1971 Shoemaker ..... E04G 17/0721 249/214
4,329,821 A 5/1982 Long et al.
4,393,635 A 7/1983 Long
4,829,733 A 5/1989 Long
4,889,310 A * 12/1989 Boeshart ..... E04B 2/8641 249/41
5,671,574 A 9/1997 Long
5,845,449 A * 12/1998 Vaughan ..... E04B 2/54 52/565
5,896,714 A * 4/1999 Cymbala ..... E04B 2/8617 52/426
6,318,040 B1 11/2001 Moore, Jr.
6,363,683 B1 4/2002 Moore, Jr.
6,435,471 B1 * 8/2002 Piccone ..... E04B 2/8641 249/191
6,519,906 B2 * 2/2003 Yost ..... E04B 2/8635 249/18
6,698,710 B1 3/2004 VanderWerf
6,739,102 B2 * 5/2004 Roy, Sr. ..... E02D 5/18 249/216
6,854,229 B2 2/2005 Keith et al.
7,409,801 B2 * 8/2008 Pfeiffer ..... E04B 2/8635 52/426

(Continued)

OTHER PUBLICATIONS

Building Science Corporation, BA-0202: Basement Insulation Systems, screen shot of webpage, Nov. 15, 2002, 7 pages.

(Continued)

*Primary Examiner* — Basil S Katcheves
(74) *Attorney, Agent, or Firm* — Standley Law Group LLP; Adam J. Smith; Jeffrey S. Standley

(57) ABSTRACT

Systems and methods for creating insulated sandwich walls with a prefabricated framework are provided. An inner strongback faces an outer strongback. Outer and inner support members are located between the strongbacks. The strongbacks and support members extend vertically from a base. Material for an outer wall, such as concrete, is deposited between the outer strongback and outer support member. Material for an inner wall is deposited between the inner strongback and inner support member. An insulating material is deposited between the outer and inner support members providing longitudinal spacing for the framework.

17 Claims, 21 Drawing Sheets

(56) References Cited

U.S. PATENT DOCUMENTS

| | | | | |
|---|---|---|---|---|
| 8,887,465 | B2 * | 11/2014 | Crosby | E04B 2/8635 52/405.4 |
| 9,033,303 | B2 | 5/2015 | McDonagh | |
| 9,145,695 | B2 | 9/2015 | Ciuperca | |
| 9,175,486 | B2 * | 11/2015 | Pfeiffer | B28B 7/02 |
| 2002/0092253 | A1 * | 7/2002 | Beliveau | B29C 44/1271 52/426 |
| 2002/0162294 | A1 * | 11/2002 | Beliveau | E04B 2/8617 52/578 |
| 2002/0178676 | A1 * | 12/2002 | Yost | E04B 2/8635 52/426 |
| 2003/0005659 | A1 * | 1/2003 | Moore, Jr. | E04B 2/8635 52/426 |
| 2003/0029106 | A1 * | 2/2003 | Cooper | E04B 2/8617 52/309.11 |
| 2005/0028467 | A1 * | 2/2005 | Bentley | E04B 2/8617 52/474 |
| 2008/0028709 | A1 * | 2/2008 | Pontarolo | E04B 2/8647 52/426 |
| 2011/0131911 | A1 * | 6/2011 | McDonagh | E04G 11/062 52/426 |
| 2012/0096797 | A1 * | 4/2012 | Garrett | E04B 2/8635 52/426 |

OTHER PUBLICATIONS

Thermomass, cast in place installation overview video, https://www.youtube.com/watch?v=mmxSI_LTVPY, Aug. 29, 2019.

Thermomass, screenshot of homepage, www.thermomass.com, Dec. 19, 2019, 2 pages.

Thermomass, Procedures for Cast-in-Place Construction-Twist Lock, Dec. 19, 2019, 2 pages.

Thermomass, Procedures for Cast-in-Place Construction Snap-Lock Retaining Button, Dec. 19, 2019, 4 pages.

* cited by examiner

SHUTTERING FRAMEWORK FOR INSULATED SANDWICH WALLS

CROSS-REFERENCE TO RELATED APPLICATIONS

This application is a makes no priority claim.

TECHNICAL FIELD

Exemplary embodiments relate generally to a shuttering framework, especially for the creation of insulated concrete sandwich walls.

BACKGROUND AND SUMMARY OF THE INVENTION

Poured concrete walls have long been used to create structures. Such concrete walls were, for many years, not insulated. Concrete walls, while providing many structural benefits, generally permit the transmission of vapor and heat, which can result in cold and clammy interior spaces. As the demand for greater energy efficiency and climate control has grown, insulation is increasingly being added to concrete walls to prevent the transmission of heat and vapor. For example, it is known to place a layer of insulation on the room side face of a concrete wall. However, such insulation may result in vapor being trapped in the interior finishes of a concrete wall, which can lead to mold and result in other undesirable outcomes. As another example, it is known to place a layer of insulation outside of a concrete wall, but such insulation may attract insect infestations and result in other undesirable outcomes. As yet another example, it is known to sandwich a layer of insulation between an interior concrete wall and an exterior concrete wall. However, sandwich walls are particularly difficult to create, especially those made of concrete. Therefore, what is needed is a shuttering framework for sandwich walls, especially those made of concrete.

A shuttering framework for sandwich walls, especially those made of concrete, is provided. The shuttering framework may include a number of framework members. The framework members may be connected to a base by way of feet which may be configured to accommodate fasteners. Alternatively, or additionally, the framework members may be connected to the base by way of a spacing device having posts which protrude therefrom and cooperate with slots located in spacing device adapters on a distal end of the framework members. The spacing device may be secured to the base by way of fasteners which may pass through apertures in the spacing device and into the base.

Each framework member may include an inner strongback, an inner support member, an outer support member, and an outer strongback. The inner strongback, the inner support member, the outer support member, and the outer strongback may be connected to one another by way of various connectors. Outer wall shuttering may be provided outside of the outer strongback. Inner wall shuttering may be provided outside of the inner strongback. Protrusions may extend from the outer and inner strongbacks for spacing the outer and inner shuttering from the strongbacks.

Insulating material, such as but not limited to a foam polystyrene, may be deposited in the space between the inner support member and the outer support member. Wall material, such as but not limited to concrete, may be deposited in the space between the inner support member and the inner shuttering, thereby surrounding at least a portion of the inner strongback and forming an inner wall, as well as in the space between the outer support member and the outer shuttering, thereby surrounding at least a portion of the outer strongback and forming an outer wall.

Reinforcement members, such as but not limited to rebar, may be placed within the deposited wall material. At least some of the connectors may comprise holders configured to accommodate the reinforcement members. Various surfaces of the connectors may be tapered, smoothed, rounded, or otherwise configured to facilitate the flow of the insulating material and/or the wall material around said connectors. Joining members may be used to connect various shuttering framework sections to create a wall for a structure. The joining members may be configured to connect sections of the sandwich wall in a linear fashion or at an angle.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
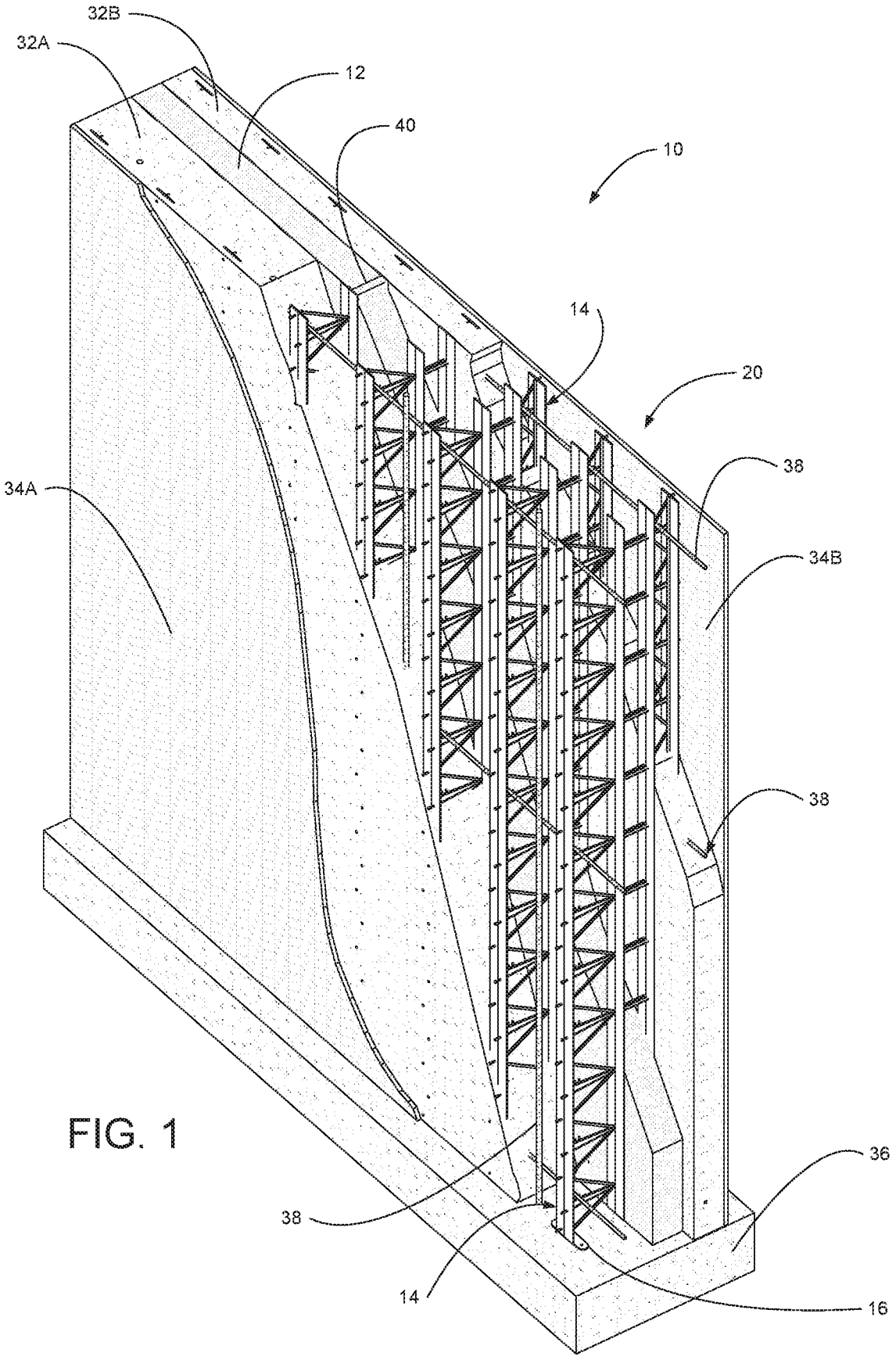
FIG. 1 is a front perspective, cutaway view of an exemplary shuttering framework section for a sandwich wall.
Figure 1A:
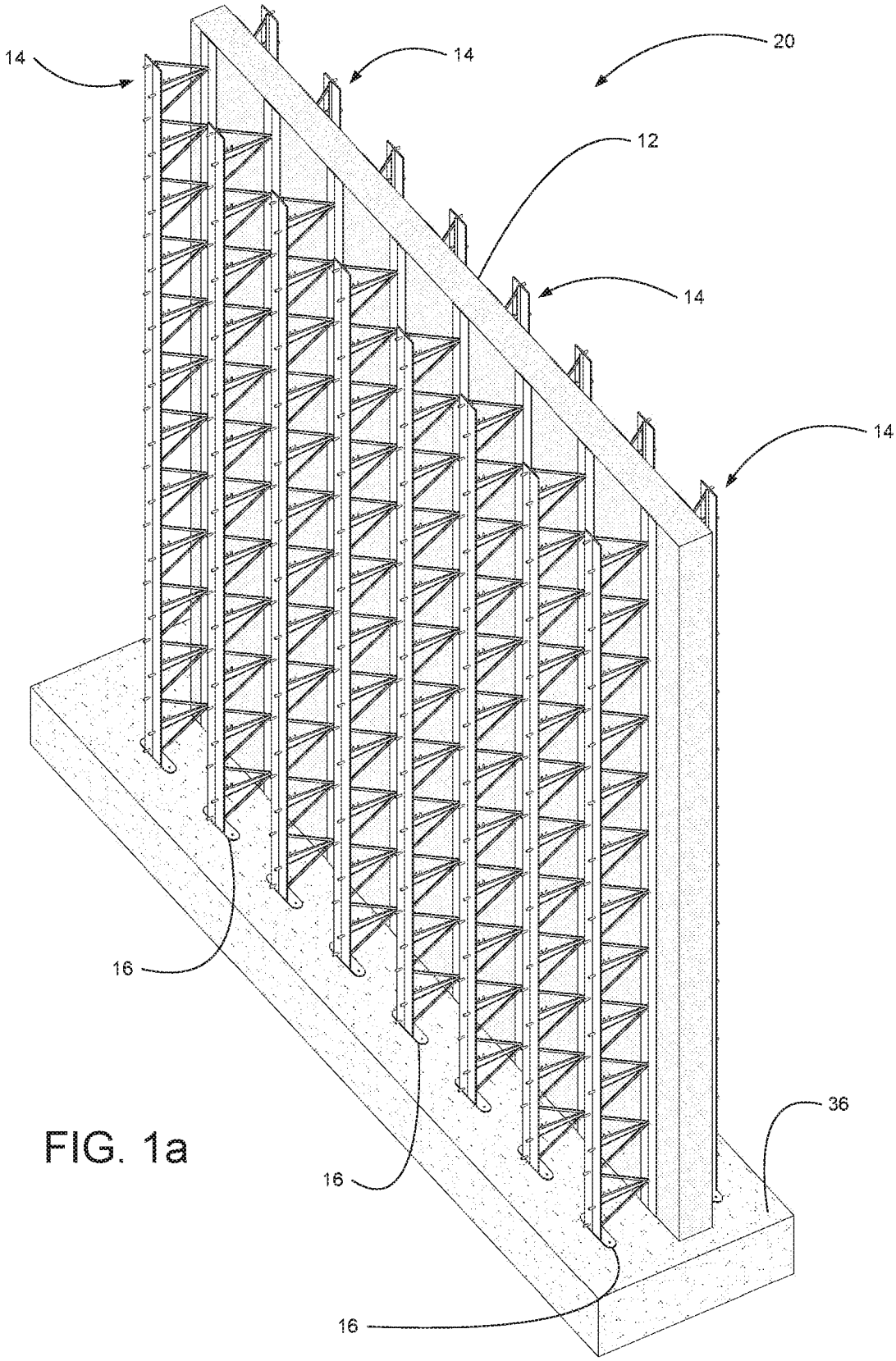
FIG. 1*a* illustrates the embodiment of FIG. 1 with certain elements removed.
Figure 2:
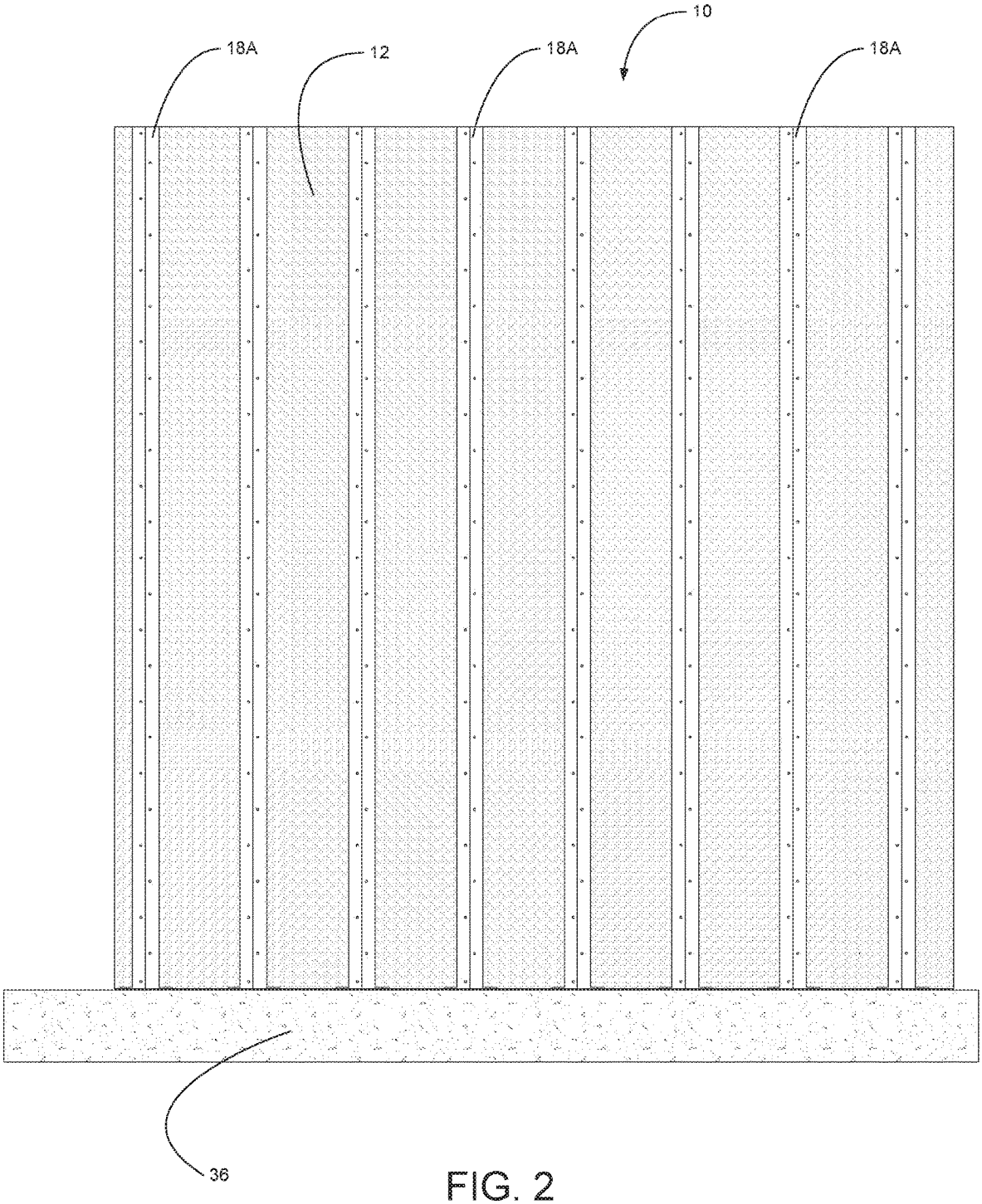
FIG. 2 is a front view of the embodiment illustrated in FIG. 1*a;*
Figure 3:
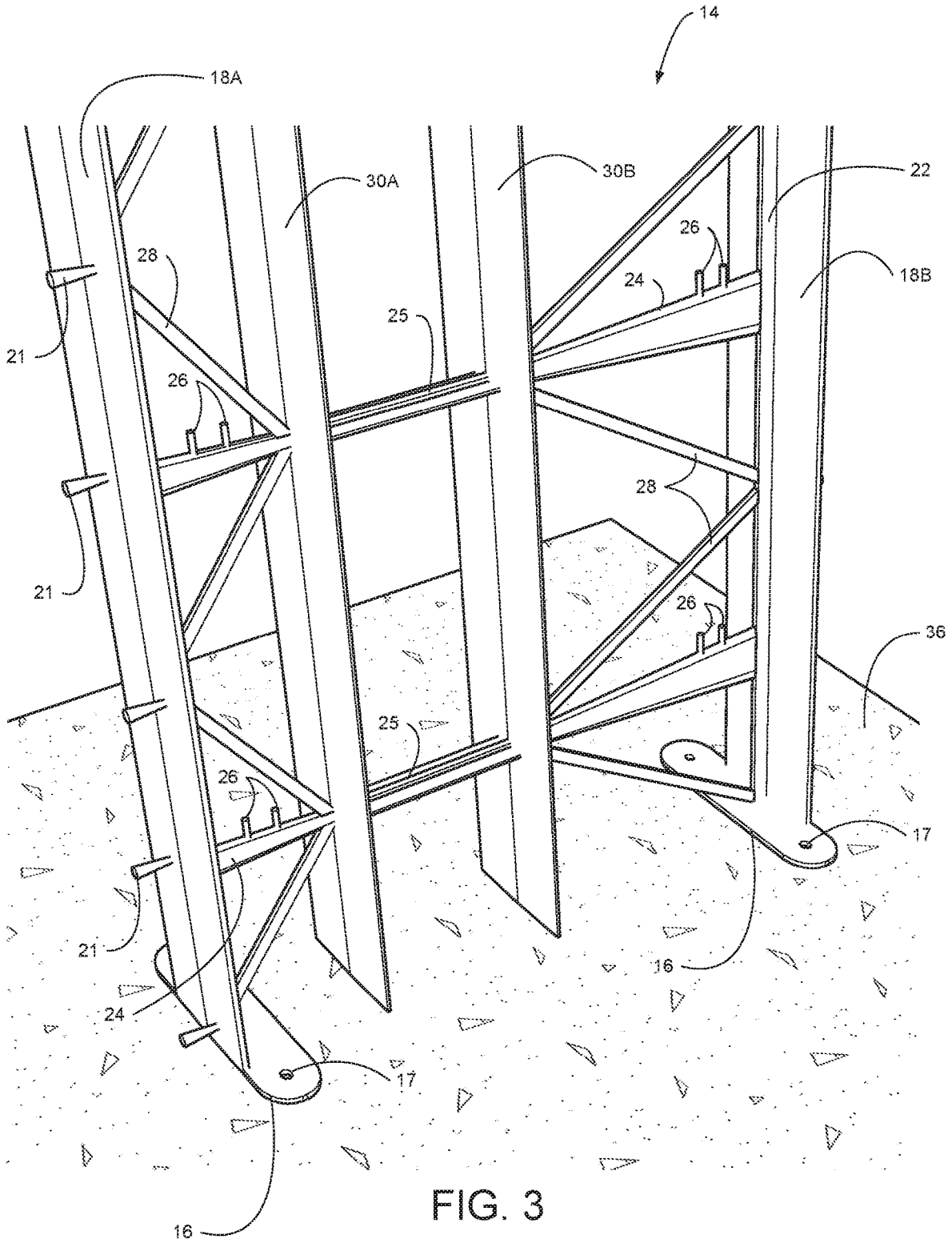
FIG. 3 is a detailed front perspective view of the embodiment of FIG. 2 with certain elements removed.
Figure 3A:
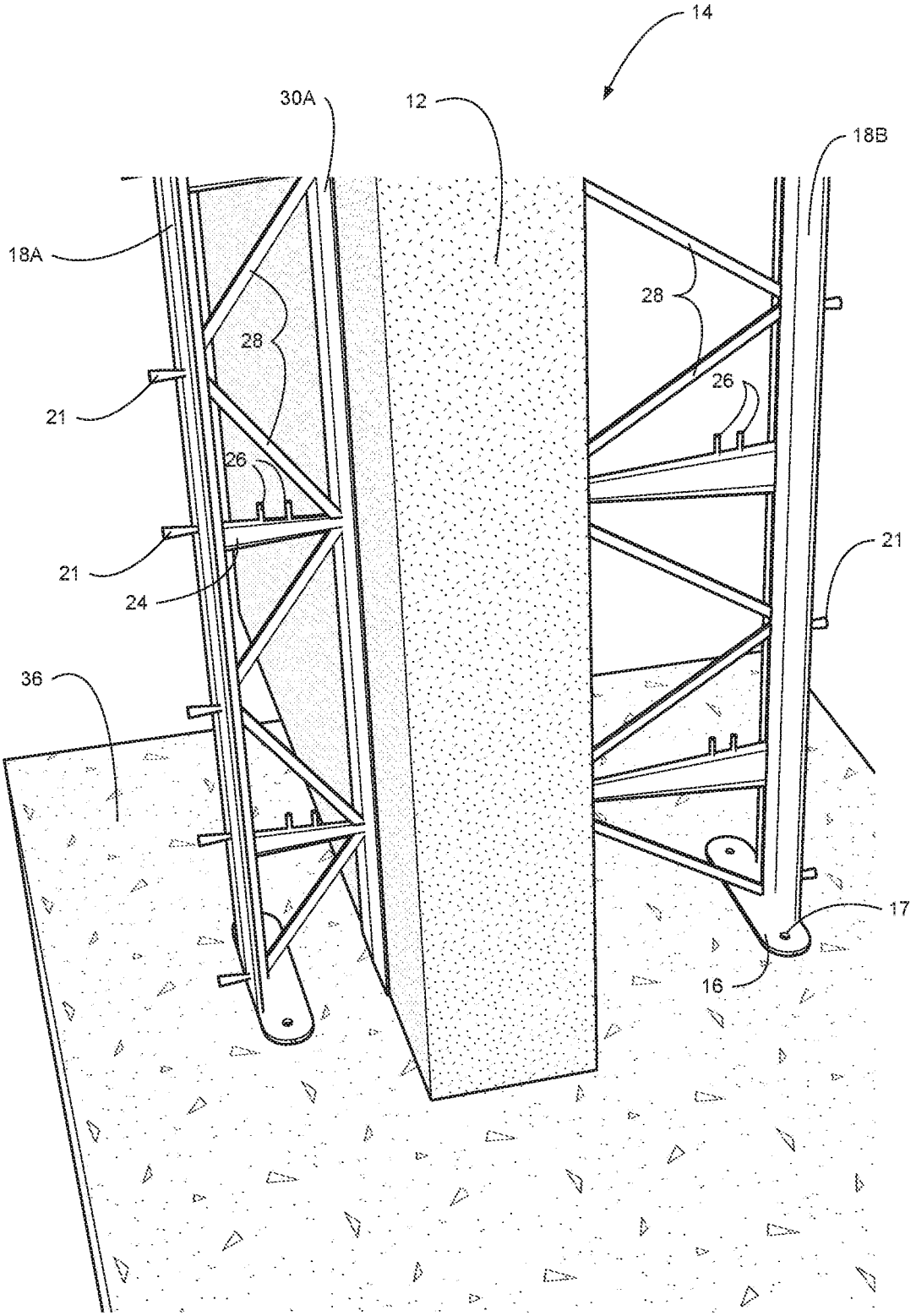
FIG. 3*a* is a detailed side perspective view of the embodiment of FIG. 1*a;*
Figure 4:
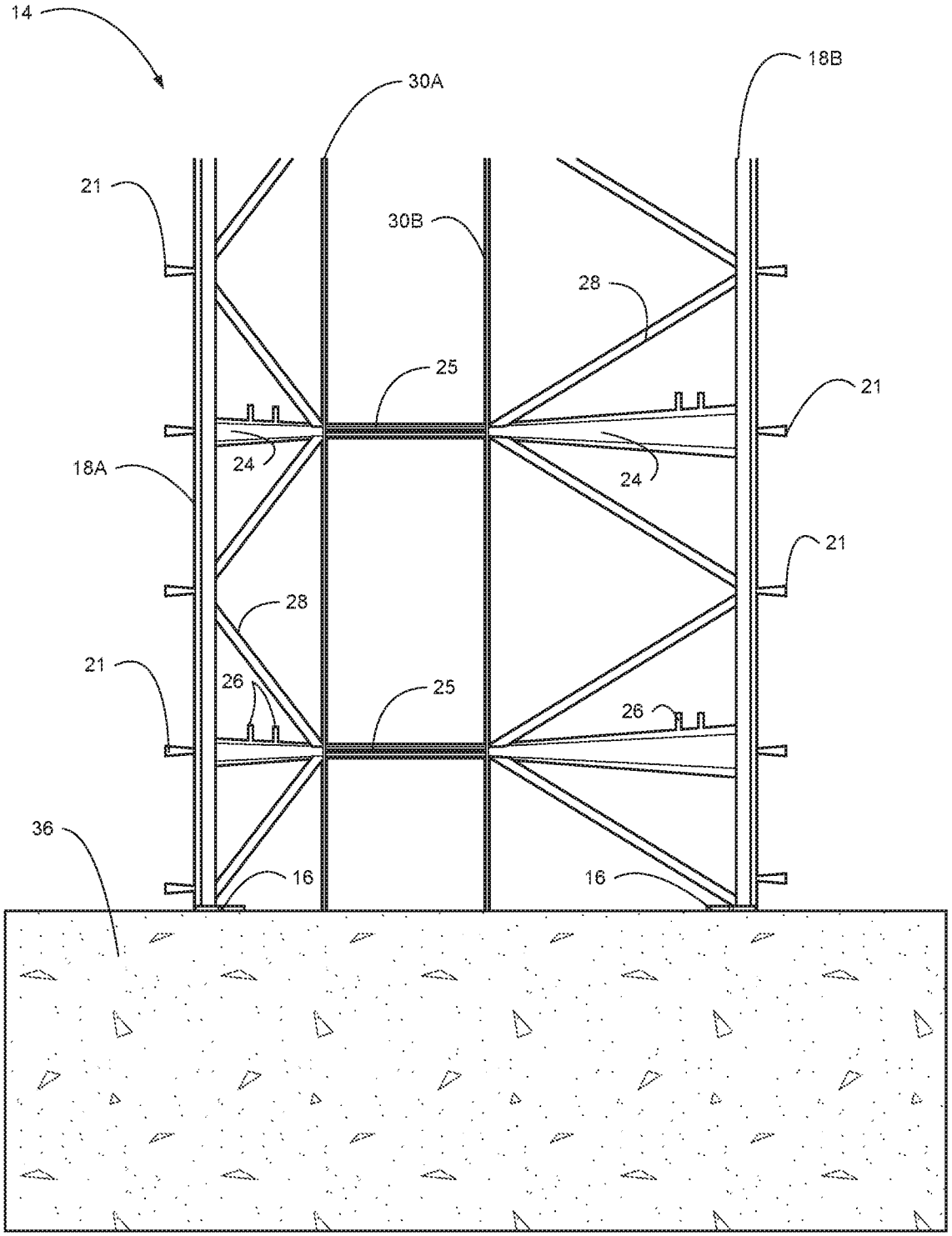
FIG. 4 is a side view of the embodiment of FIG. 3.
Figure 4A:
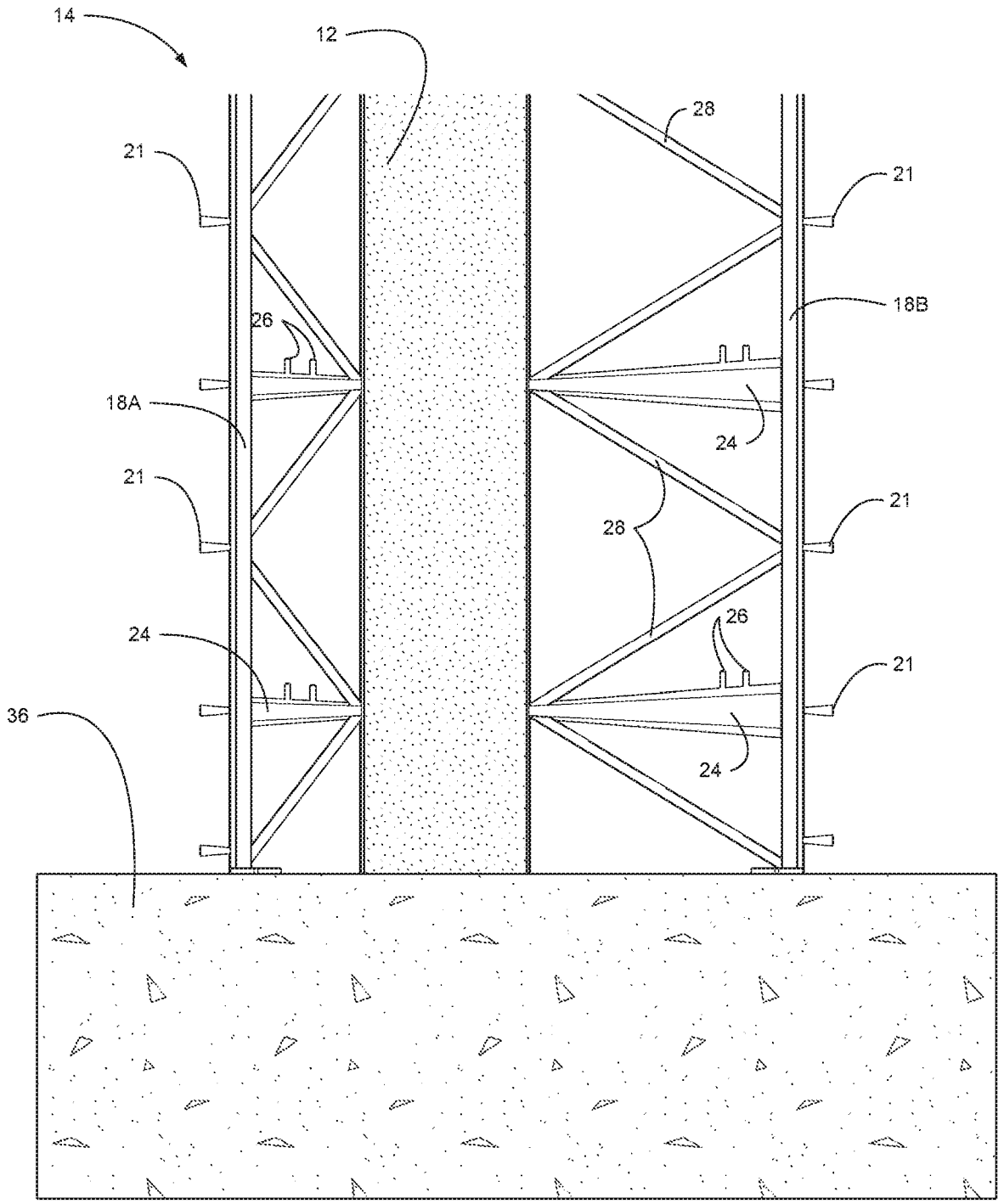
FIG. 4*a* is a side view of the embodiment of FIG. 3*a;*
Figure 5:
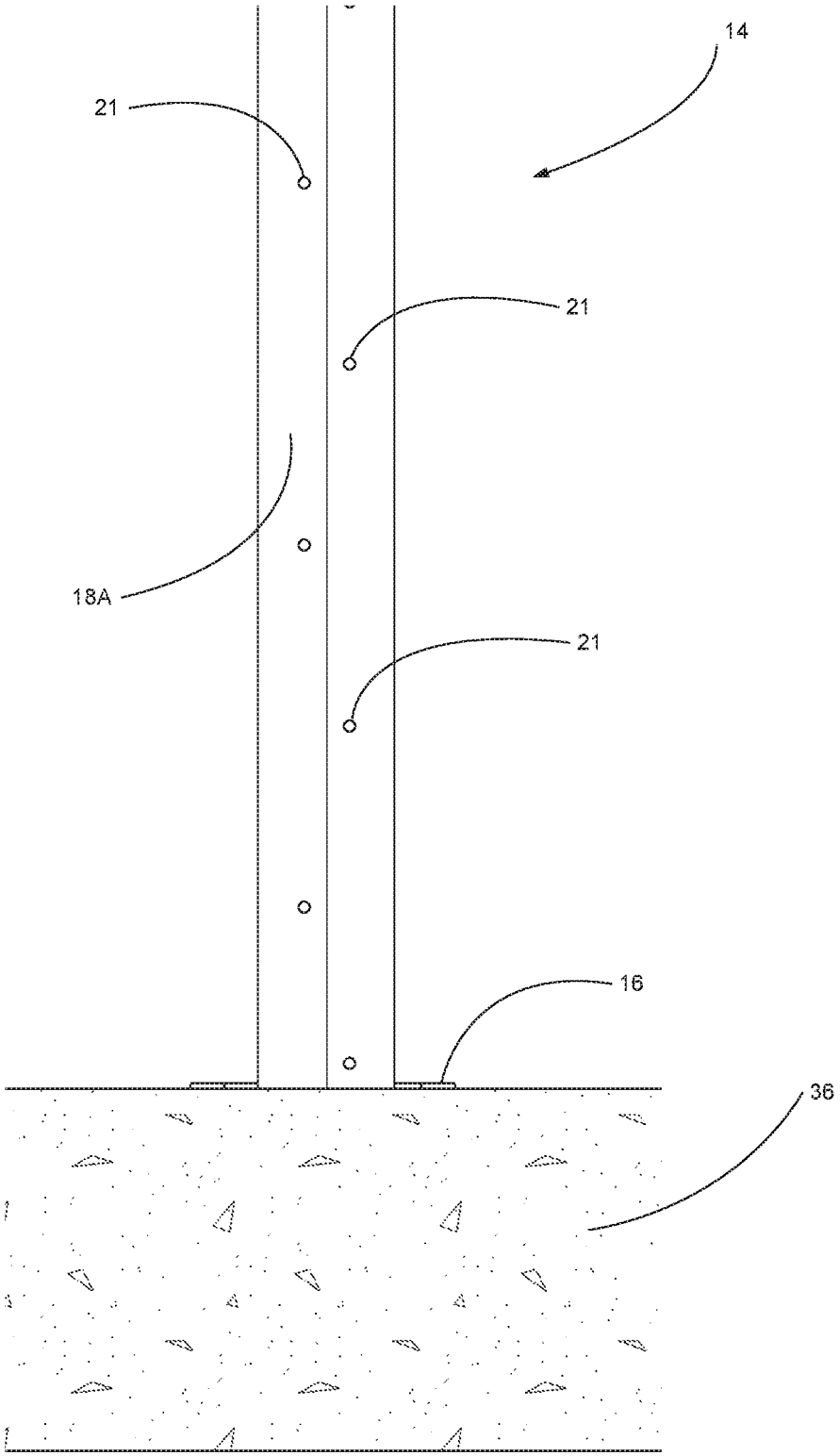
FIG. 5 is a detailed front view of a single framework member, illustrated in isolation.
Figure 5A:
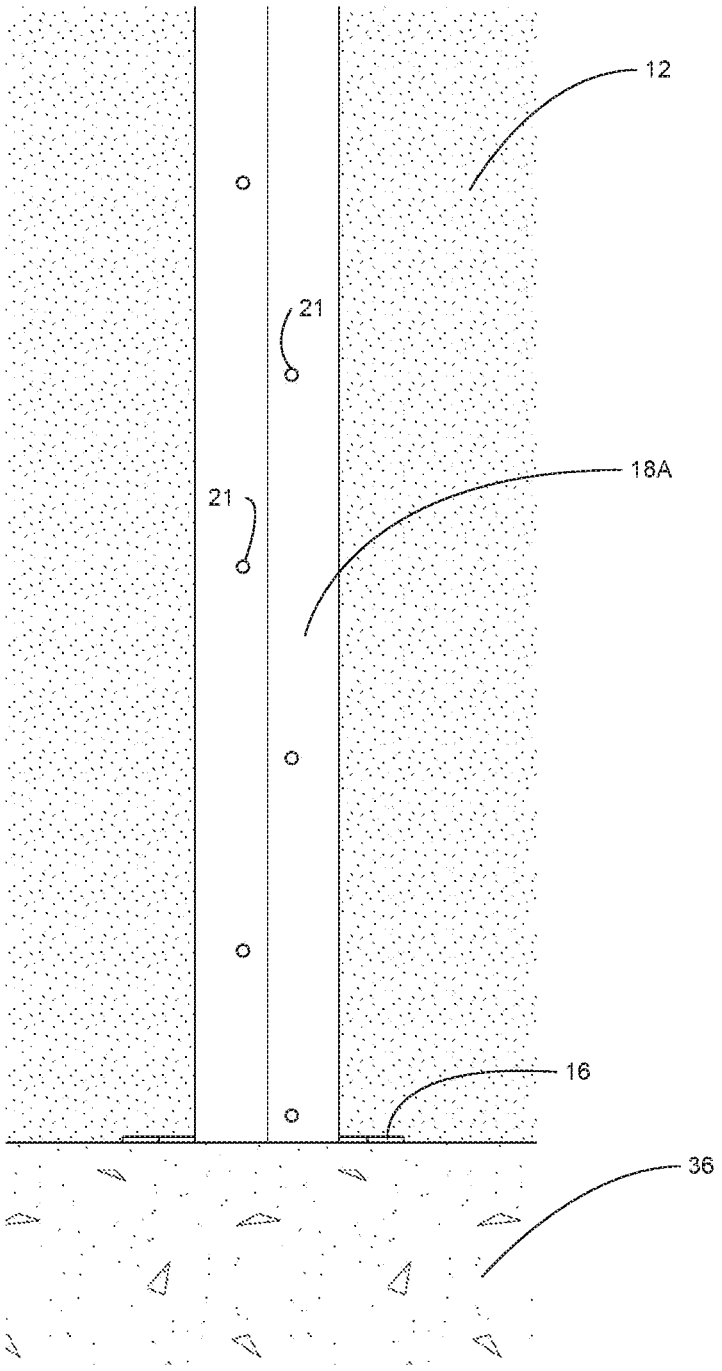
FIG. 5*a* is the framework member of FIG. 5 with an insulating core installed.
Figure 6:
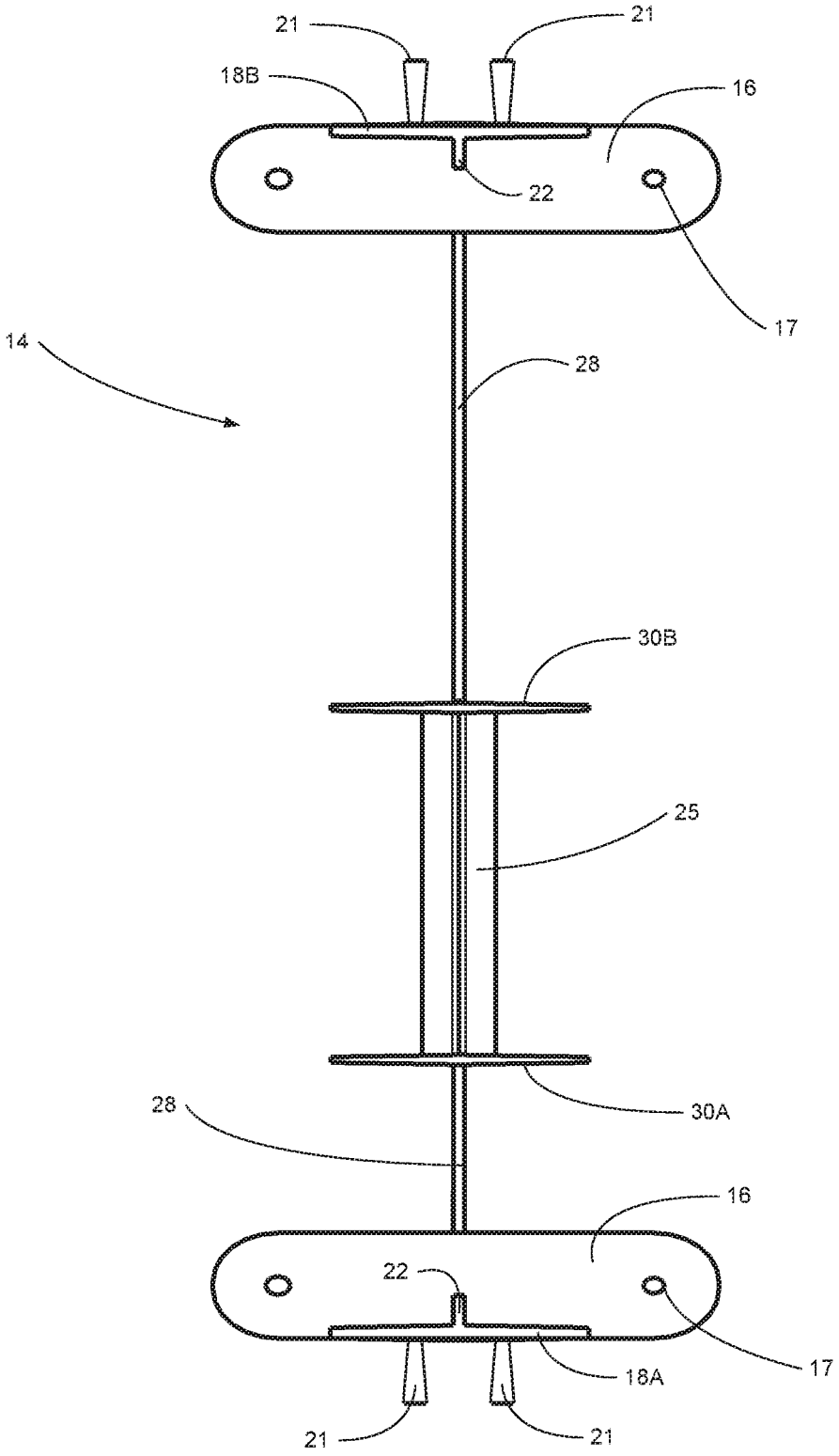
FIG. 6 is a top view of the single framework member, illustrated in isolation.
Figure 6A:
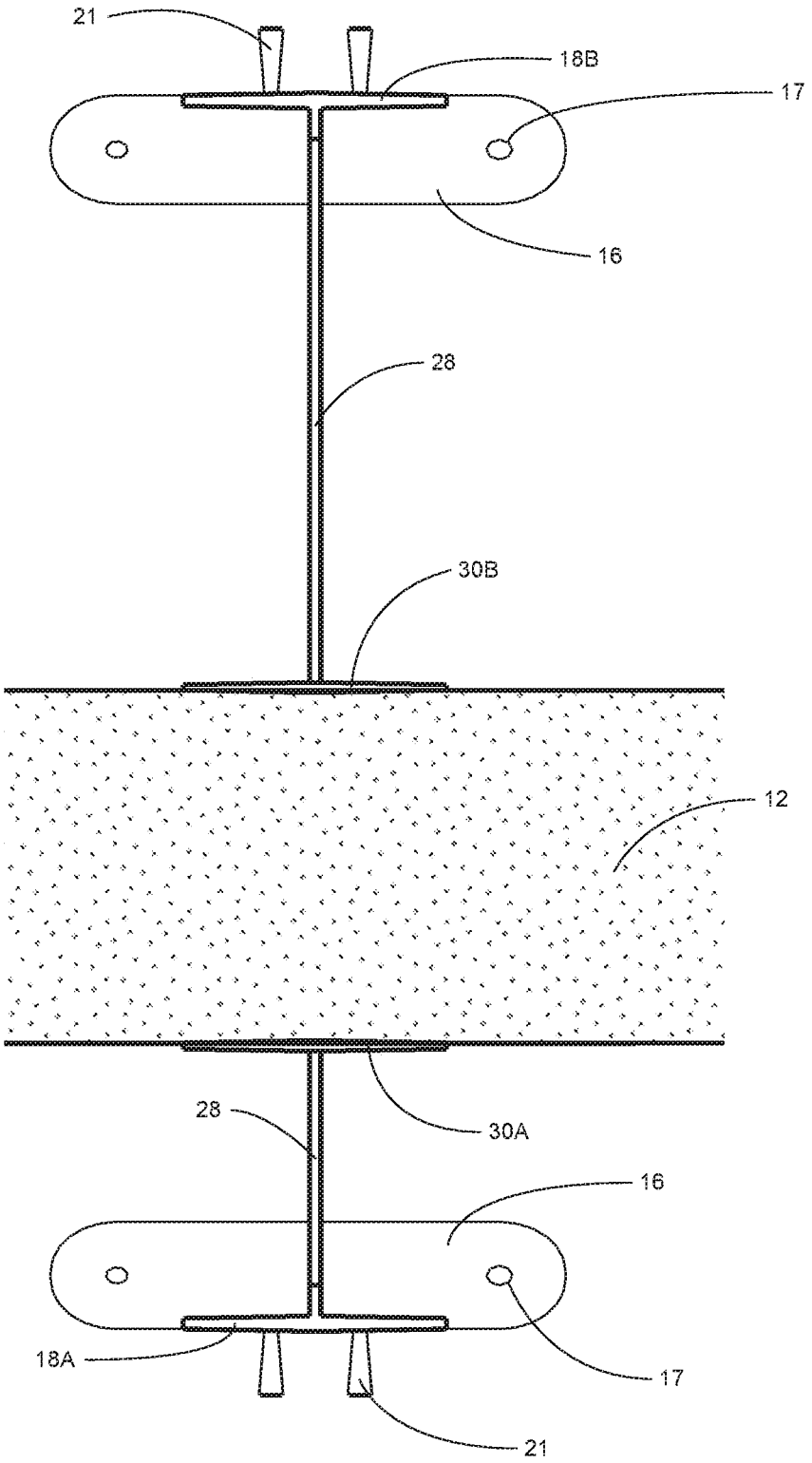
FIG. 6*a* is a top view of the single framework member with an insulating core installed.

FIG. 1 and FIG. 2 illustrate various views of an exemplary shuttering framework section 20 for a sandwich wall 10. The shuttering framework section 20 may comprise a number of framework members 14. The framework members 14 may be configured to support, at least partially, an outer wall 32A, an insulating core 12, and an inner wall 32B. The framework members 14 may be comprised of metal, though any type of material is contemplated. The shuttering framework section 20 may be configured to support the insulating core 12 between the outer wall 32A and the inner wall 32B, thus sandwiching the insulating core 12. The insulating core 12 may be comprised of a foamed polystyrene, though any type of material is contemplated. In exemplary embodiments, the outer wall 32A and the inner wall 32B may be comprised of concrete, though any type of material is contemplated. The concrete may be provided in a liquid, or semi-liquid form for pouring and allowed to cure once deposited to form a solid.

The shuttering framework section 20 may further comprise an outer wall shuttering 34A and an inner wall shuttering 34B. The outer wall shuttering 34A and the inner wall shuttering 34B may be comprised of a series of panels, which may be comprised of wood, though any material is contemplated. The outer wall shuttering 34A and the inner wall shuttering 34B may be placed outside of the framework members 14. The outer wall shuttering 34A and the inner wall shuttering 34B may be configured to support the outer wall 32A and the inner wall 32B, respectively. The insulating core 12 may further support the outer wall 32A and the inner wall 32B. In exemplary embodiments, the outer wall shuttering 34A and the inner wall shuttering 34B may be temporarily structures erected to support the material comprising the outer wall 32A and the inner wall 32B, such as concrete for example without limitation, while the material is deposited between the insulating core 12 and the outer wall shuttering 34A as well as between the inner wall shuttering 34B and the insulating core 12 and allowed to cure.

The sandwich wall 10 may extend wholly or partially across a foundation member 36. The base 36 may be comprised of concrete, though such is not required. The framework members 14 may each extend from the foundation member 36.

A number of reinforcement members 38 may be provided within the outer wall 32A. A number of reinforcement members 38 may be provided within the inner wall 32B. A first portion of said number of said reinforcement members 38 may extend vertically. A second portion of said number of reinforcement members 38 may extend horizontally. However, any number and orientation of said reinforcement members 38 is contemplated. In exemplary embodiments, said reinforcement members 38 comprise rebar, though any type of material is contemplated.

In exemplary embodiments, each of the framework members 14 may be of sufficient height so as to extend from the foundational member 36, when installed, to at least a desired height of the outer wall 32A and the inner wall 32B. The outer wall shuttering 34A and the inner wall shuttering 34B may be substantially the same height as the framework members 14. At least some of the reinforcement members 38 may be substantially the same height as the framework members 14. At least some other of the reinforcement members 38 may be sized to span at least the length of the framework section 20. The insulating core 12 may be substantially the same height as the framework members 14. The insulating core 12 may be sized to span at least the length of the framework section 20. In exemplary embodiments, the insulating core 12 may be provided in as a liquid, or in semi-liquid form, and allowed to expand as a foam and cure. In other exemplary embodiments, the insulating core 12 may be comprised of one or more panels.

A number of shuttering framework sections 20, and various components thereof, may be provided in a number of orientations so as to form various sandwich walls 10 for a structure. For example, without limitation, a number of the shuttering framework sections 20 may be provided to form a sandwich wall 10 for an entire basement for a residential home, though any application is contemplated. A corresponding foundational member 36 may be provided.

FIG. 3 through FIG. 6*a* illustrate various views of the framework members 14. Each of the framework members 14 may comprise an outer strongback 18A and an inner strongback 18B. In exemplary embodiments, the outer strongback 18A and the inner strongback 18B may each be shaped as substantially rectangular members, though any shape is contemplated. The outer strongback 18A and the inner strongback 18B may extend vertically from the base 36, when installed. The outer strongback 18A and the inner strongback 18B may extend substantially parallel to one another. The outer strongback 18A and the inner strongback 18B may each comprise feet 16. The feet 16 may be substantially oval in shape and may be located at a distal end of the strongbacks 18A and 18B. The feet 16 may each comprise one or more apertures 17, which may be configured to accommodate a fastener for securing the framework member 14 to the base 36.

A number of projections 21 may extend horizontally from an outer surface of the outer strongback 18A and from an outer surface of the inner strongback 18B. The projections 21 may be spaced apart from one another. The projections 21 may be substantially conical or cylindrical in shape, though any shape is contemplated. The projections 21 may be configured to provide spacing between the outer surface of the outer strongback 18A and the outer wall shuttering 34A as well as between the outer surface of the inner strongback 18B and the inner wall shuttering 34B.

Each of the framework members 14 may further comprise an outer support member 30A and an inner support member 30B. In exemplary embodiments, the outer support member 30A and the inner support member 30B may each be shaped as substantially rectangular members, though any shape is contemplated. The outer support member 30A and the inner support member 30B may extend vertically from the base 36, when installed. The outer support member 30A and the inner support member 30B may extend substantially parallel to one another.

A number of connecting members 25 may extend between the outer support member 30A and the inner support member 30B. The connecting members 25 may be spaced apart from one another along some or all of the length of the outer support member 30A and the inner support member 30B. The connecting members 25 may be substantially rectangular in shape, though any shape is contemplated. The connecting members 25 may be configured to provide strength and rigidity to the framework section 20, particularly against lateral forces. The connecting members 25 may comprise smoothed edges, rounded edges, tapered edges, or other features to accommodate the deposit of the material comprising the insulating core 12.

Stiffeners 22 may protrude inwardly from each of the outer strongback 18A and the inner strongback 18B. One of the stiffeners 22 may extend along substantially the entire length of the outer strongback 18A and the inner strongback 18B, respectively. The stiffeners 22 may be substantially rectangular shaped. The stiffeners 22 may be configured to provide structural rigidity and strength. The stiffeners 22 may be integrally formed with the strongbacks 18A and 18B.

A number of horizontal connectors 24 may extend from the stiffeners 22 or the outer strongback 18A to the outer support member 30A. A number of horizontal connectors 24 may extend from the stiffeners 22 or the inner strongback 18B to the inner support member 30B. The horizontal connectors 24 may extend substantially horizontally. The horizontal connectors 24 may be spaced apart from one another along some or all of the length of the framework member 14. The horizontal connectors 24 may comprise tapered, rounded, smoothed edges, some combination thereof, or the like. Such features may be configured to improve the flow of the material deposited to form the outer wall 32A and the inner wall 32B around the horizontal connectors 24. The horizontal connectors 24 may be configured to provide strength and rigidity to the framework section 20, particularly against lateral forces.

A number of angled connectors 28 may extend between the stiffeners 22 or the outer strongback 18A to the outer support member 30A. A number of angled connectors 28 may extend from the stiffeners 22 or the inner strongback 18B to the inner support member 30B. The angled connectors 28 may be located between the horizontal connectors 24, though such is not required. The angled connectors 28 may extend at an angle from the inner surface of the outer strongback 18A and the inner surface of the inner strongback 18B to the outer support member 30A and the inner support member 30B, respectively. In exemplary embodiments, the angled connectors 28 may extend in an alternating upward and downward fashion. However, any angle and orientation of the angled connectors 28 is contemplated. The angled connectors 28 may comprise tapered, rounded, smoothed edges, some combination thereof, or the like. Such features may be configured to improve the flow of the material deposited to form the outer wall 32A and the inner wall 32B around the angled connectors 28. The angled connectors 28 may be configured to provide strength and rigidity to the framework section 20, particularly against lateral forces.

A number of holders 26 may extend vertically from the horizontal connectors 24. Each holder 26 may comprise a first and second vertically extending protrusion. The holders 26 may be configured to secure at least some of the reinforcement members 38. In exemplary embodiments, the holder 26 are configured to secure the horizontally extending reinforcement members 38.

The space between the outer wall shuttering 34A and the outer support member 30A may be configured to receive the material comprising the outer wall 32A, such as, without limitation concrete. In this way, such material may surround the outer strongback 18A. The space between the inner wall shuttering 34B and the inner support member 30B may be configured to receive the material comprising the inner wall 32B, such as, without limitation, concrete. In this way, such material may surround the inner strongback 18A. The space between the outer support member 30A and the inner support member 30B may be configured to receive the material comprising the insulating core 12, such as, without limitation, a foamed polystyrene. The amount of material deposited in the various spaces may be selected to substantially fill the respective spaces.

A gap between the outer strongback 18A and the outer support member 30A may be larger than a gap between the inner strongback 18B and the inner support member 30B, though the reserve is contemplated. Alternatively, the gap between the outer strongback 18A and the outer support member 30A may be substantially the same size as the gap between the inner strongback 18B and the inner support member 30B.

Figure 7:
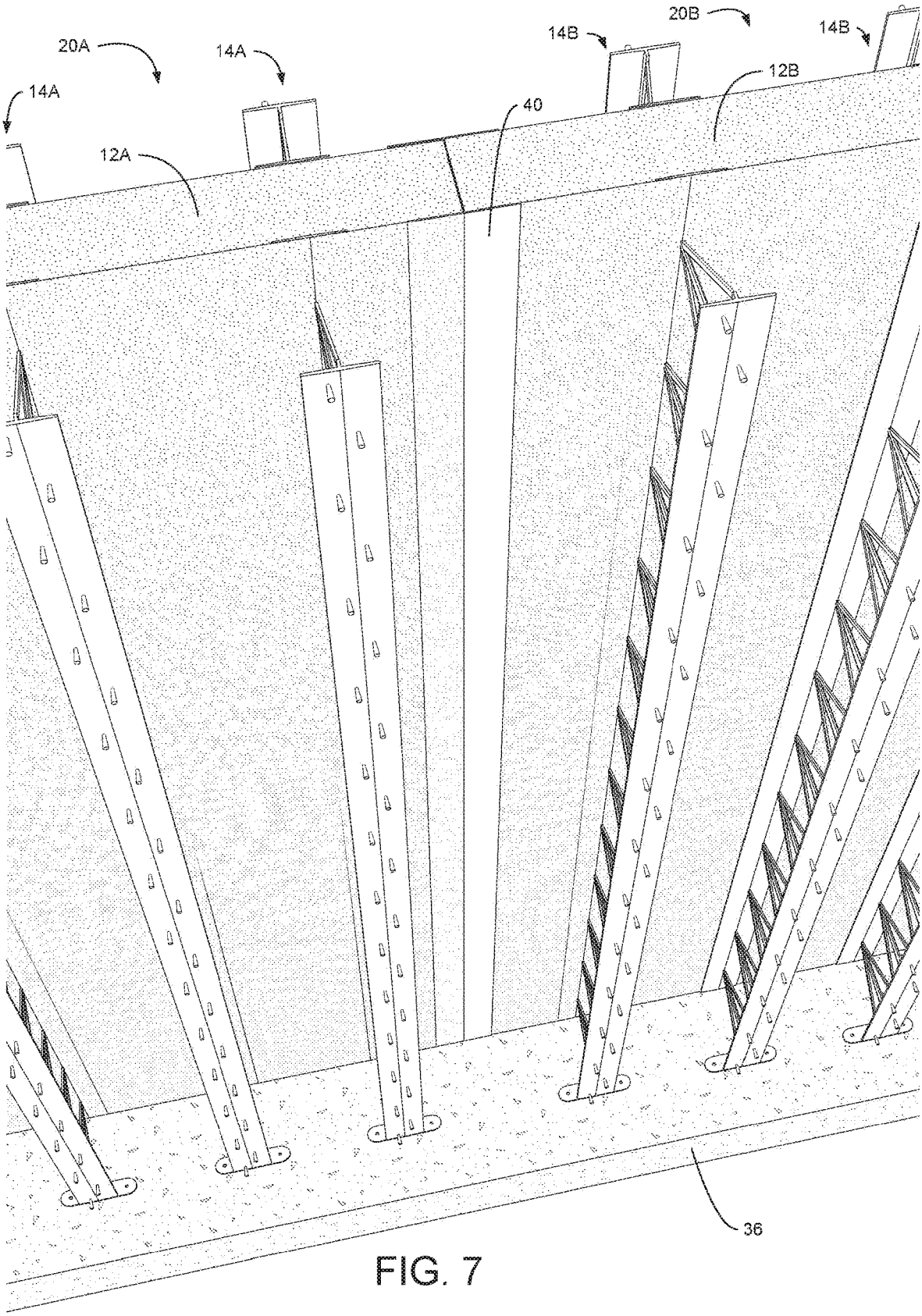
FIG. 7 is a top perspective view of the embodiment of FIG. 1 joined with an additional framework section in a linear fashion.
Figure 7A:
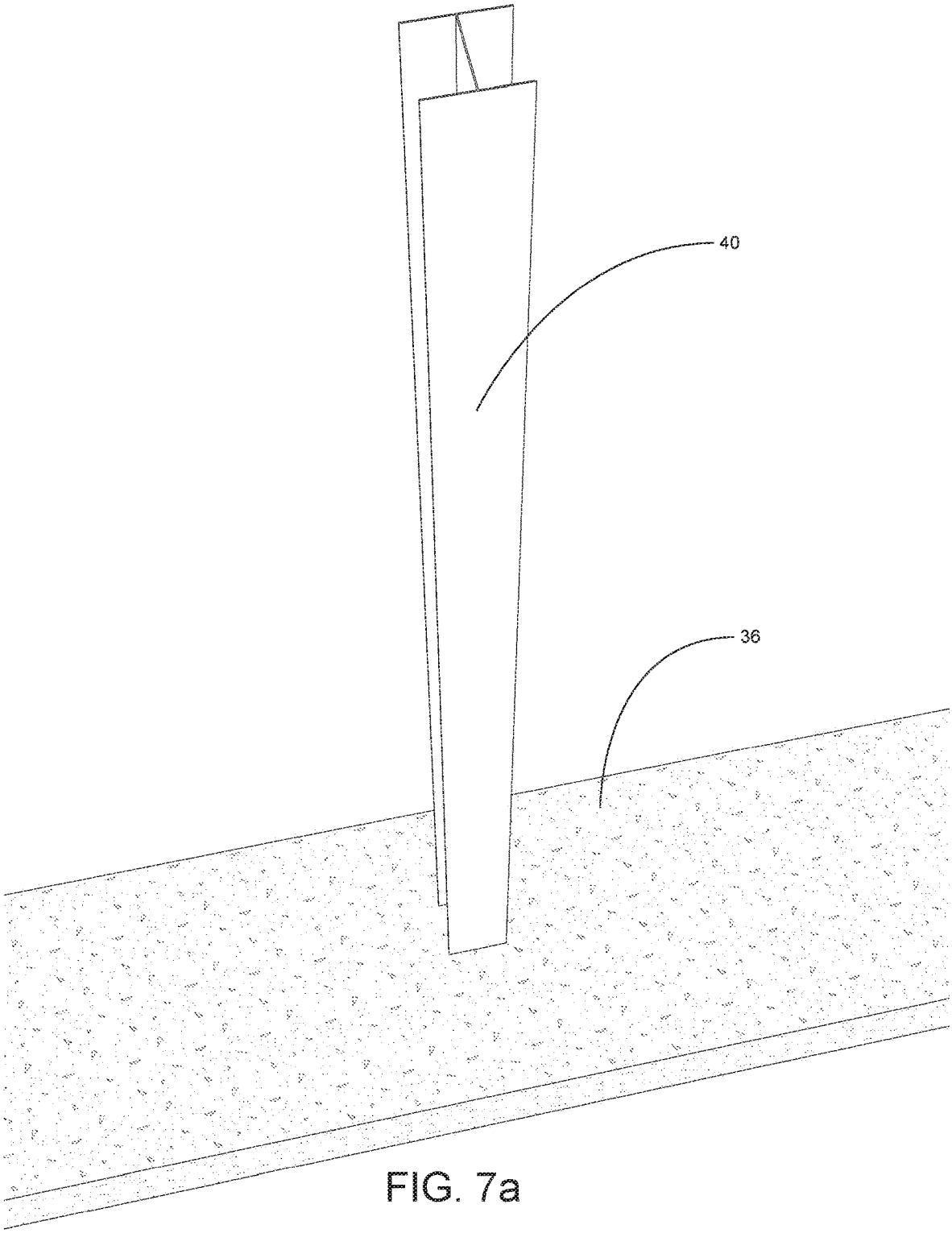
FIG. 7*a* is a top perspective view of a linear adjoining member illustrated in insulation.

FIG. 7 through FIG. 7A illustrate a joining member 40. The joining member 40 may be configured to join a first shuttering framework section 20A and a second shuttering framework section 20B in a substantially linear fashion. The joining member 40 may be provided between the framework members 14A of the first framework section 20A and the framework members 14B of the second framework section 20B. The joining member 40 may be a substantially "I" shaped member, such as but not limited to an I-beam. The joining member 40 may be comprised of a single piece or two substantially "U" shaped pieces joined together. The joining member 40 may be configured to join the insulating core 12A of the first framework section 20A with the insulating core 12B of the second framework section 20B.

Figure 8:
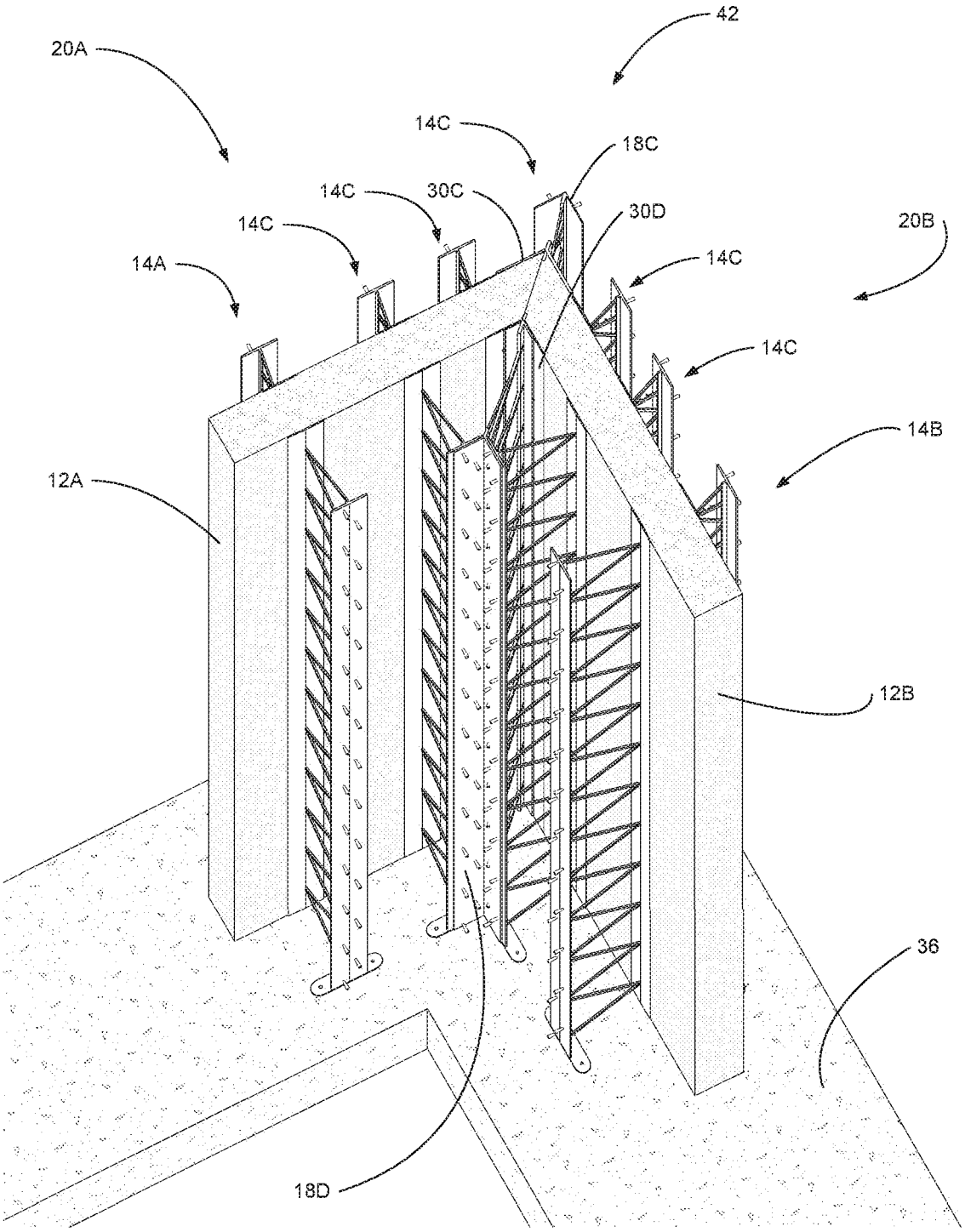
FIG. 8 is a top perspective view of the embodiment of FIG. 1 joined with an additional framework section at an angle.
Figure 8A:
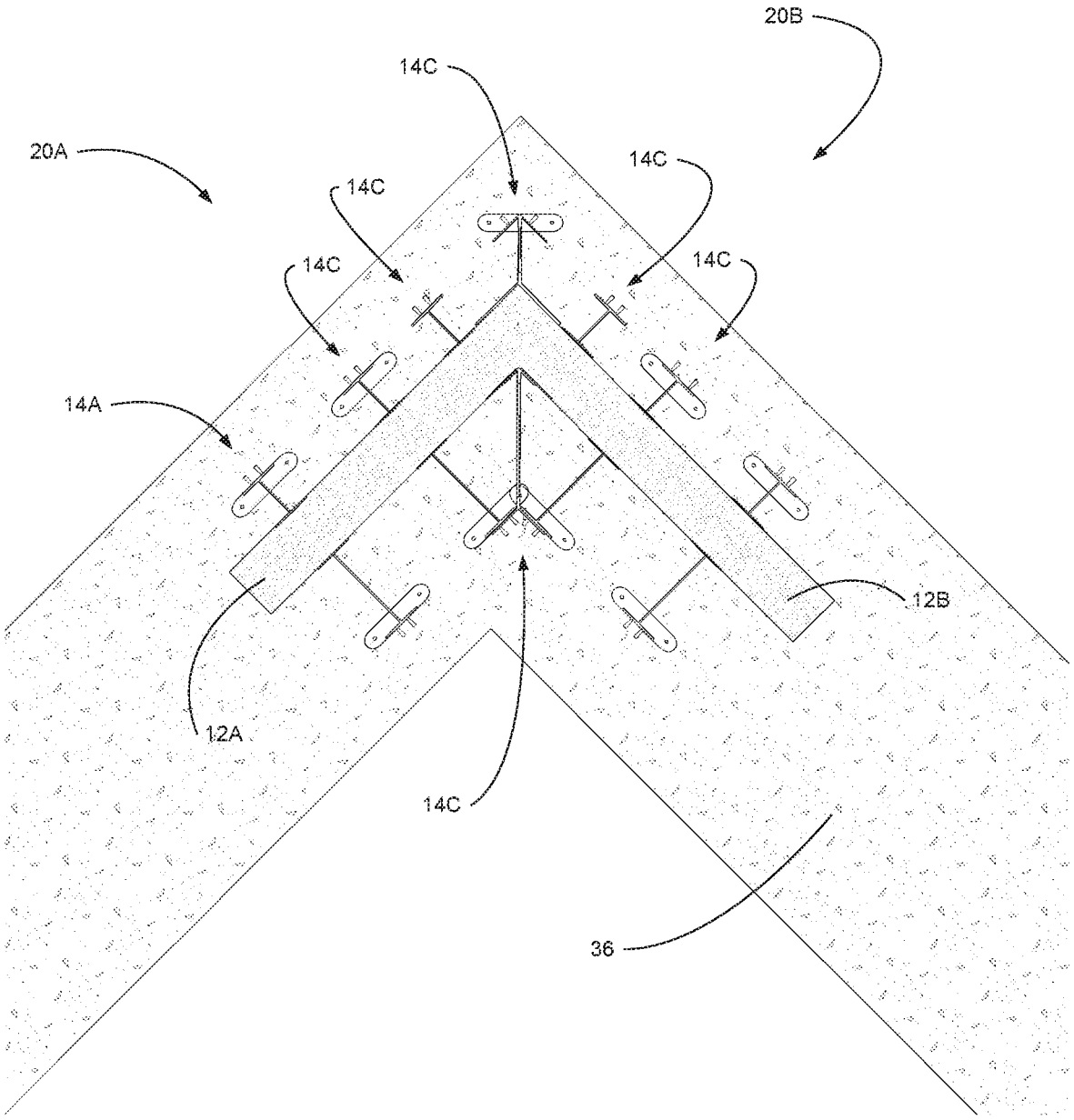
FIG. 8*a* is a top view of the embodiment of FIG. 8.

FIG. 7*a* through FIG. 8 illustrate a corner joining member 42. The corner joining member 42 may be configured to join the first shuttering framework section 20A and the second shuttering framework section 20B at an angle, such as 90 degrees though any angle is contemplated. The corner joining member 42 may comprise a number of framework members 14C. The framework members 14C may comprise one or more of: outer strongbacks 18C, outer support members 30C, inner support members 30D, and inner strongbacks 18D, each of which may be provided at an angle relative to one another. The angle may match the desired angle of the sandwich wall 10. The corner joining member 42 may be configured to join the insulating core 12A of the first shuttering framework section 20A with the insulating core 12B of the second framework section 20B. In exemplary embodiments, multiple outer strongbacks 18A and outer support members 30A may be provided in a given corner joining member 42 while only a single inner strongback 18B and a limited number of inner support members 30B are provided. In other exemplary embodiments, multiple inner strongbacks 18B and inner support members 30B may be provided in a given corner joining member 42 while only a single outer strongback 18A and a limited number of outer support members 30A are provided. Any number of outer strongbacks 18A, outer support members 30A, inner support members 30B, and inner strongbacks 18B may be utilized to form the corner joining member 42 at any desired angle.

Figure 9:
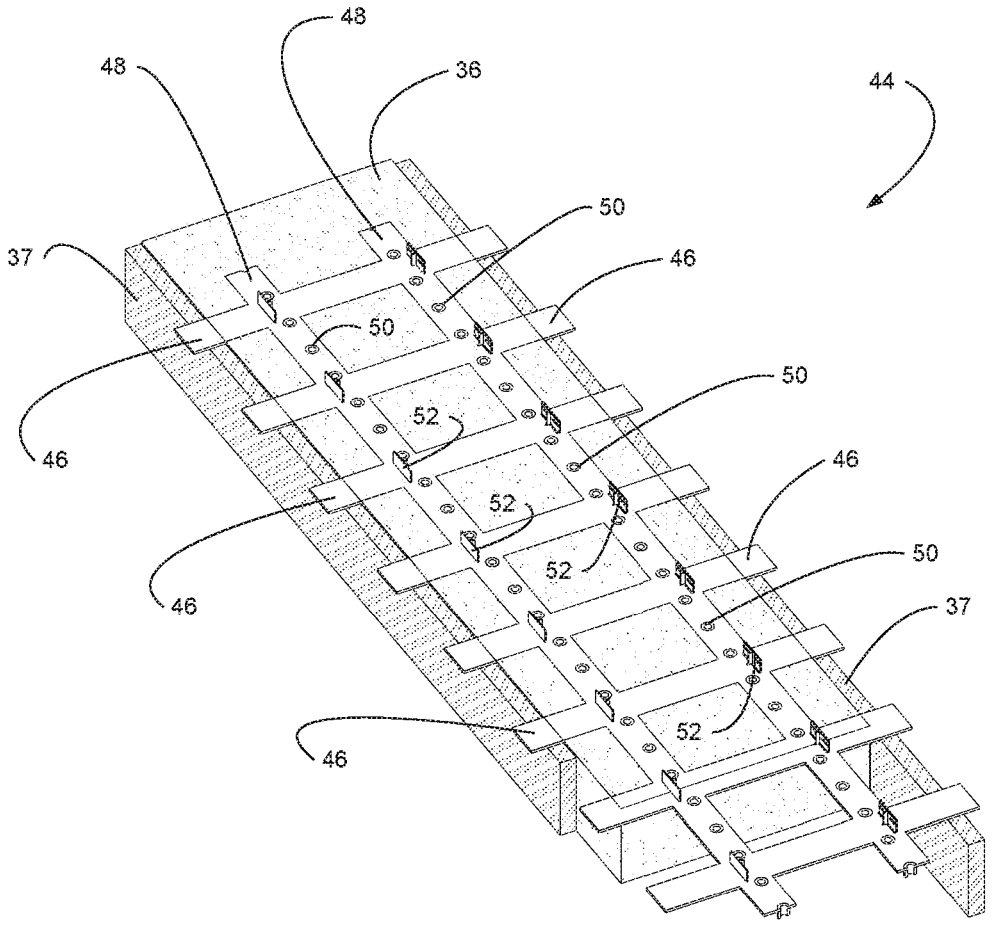
FIG. 9 is a top cutaway perspective view of a spacing device and foundational member.
Figure 9A:
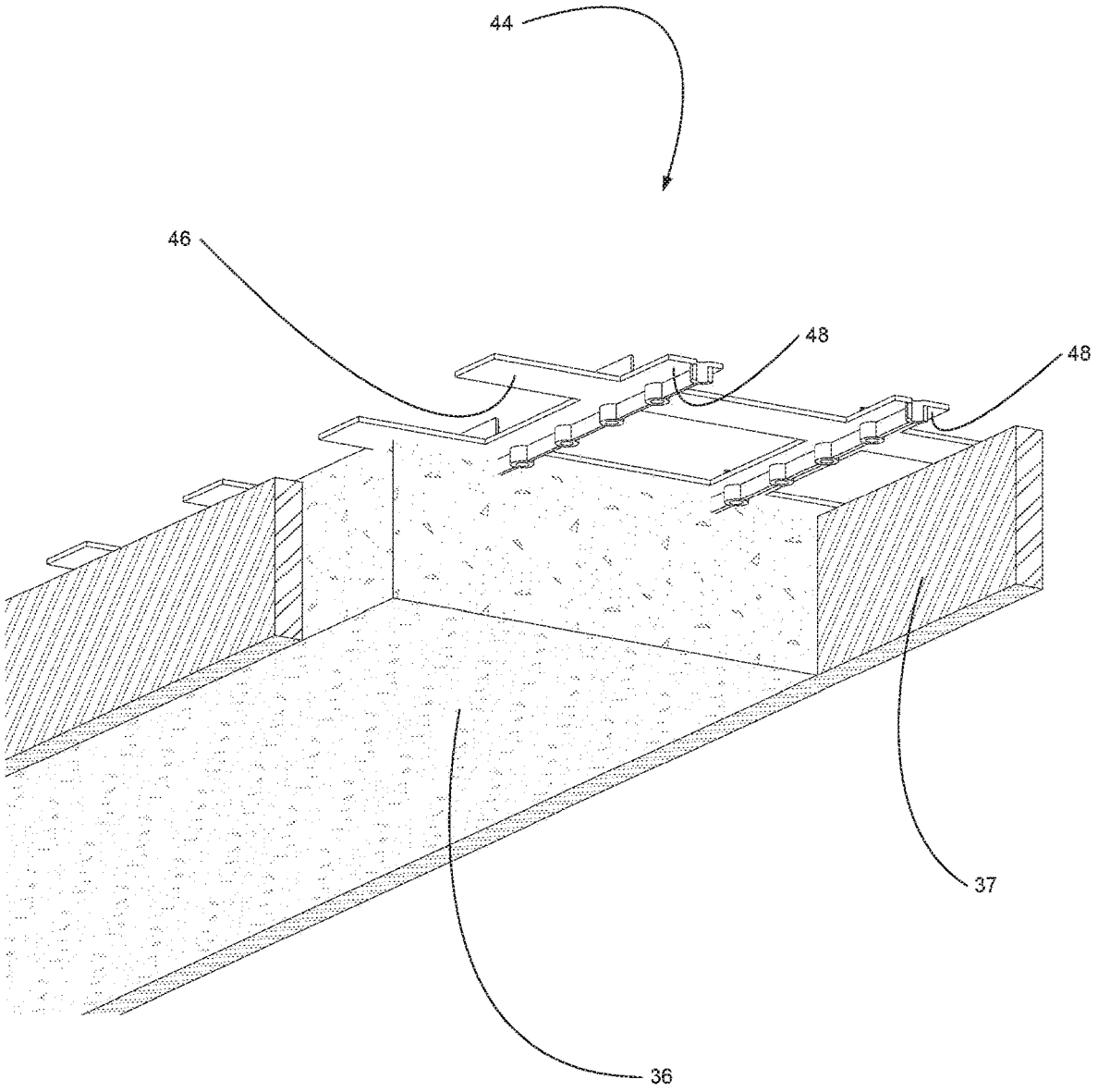
FIG. 9*a* is a bottom cutaway perspective view of the embodiment of FIG. 9.
Figure 9B:
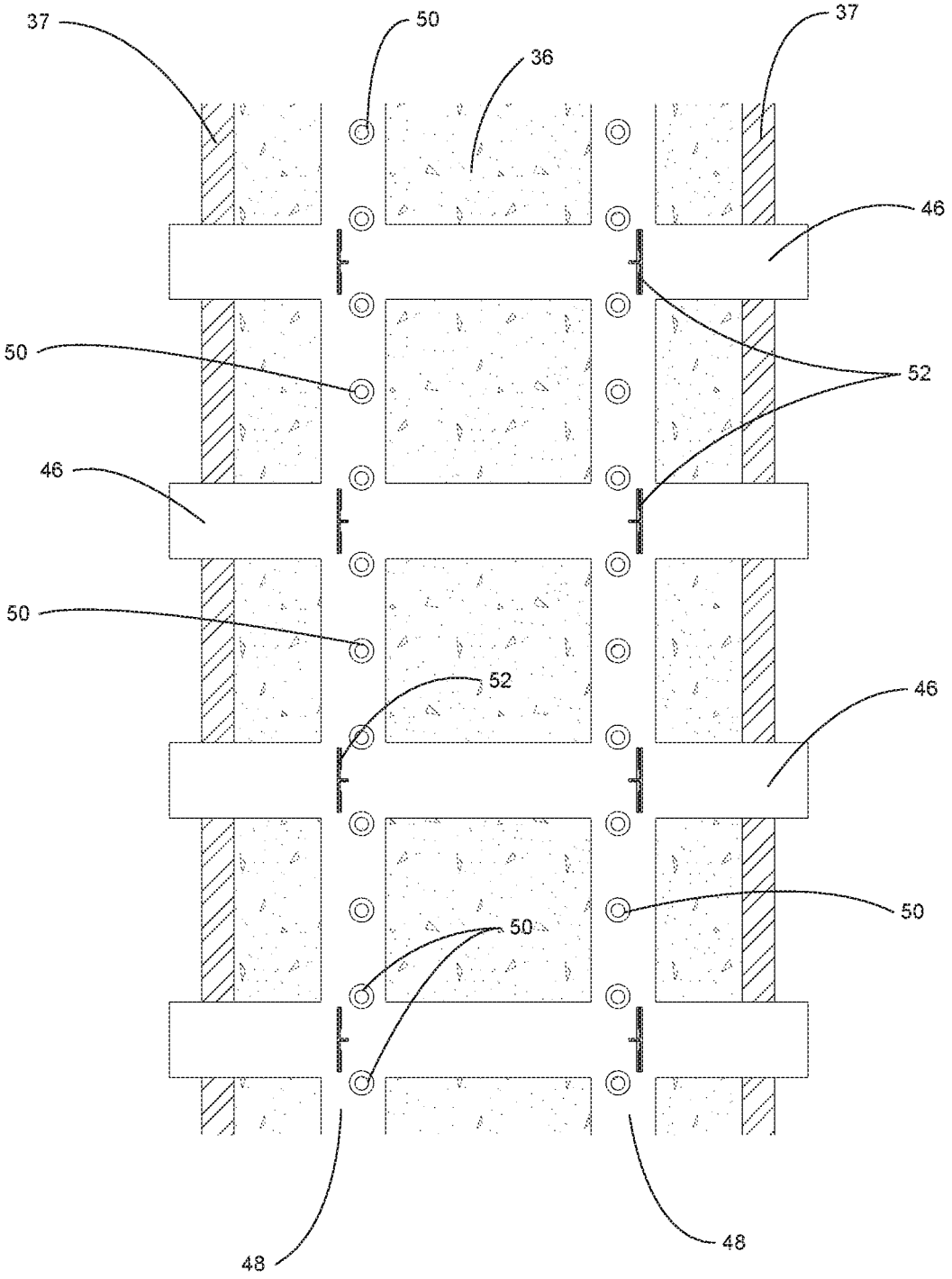
FIG. 9*b* is a top view of the embodiment of FIG. 9.
Figure 9C:
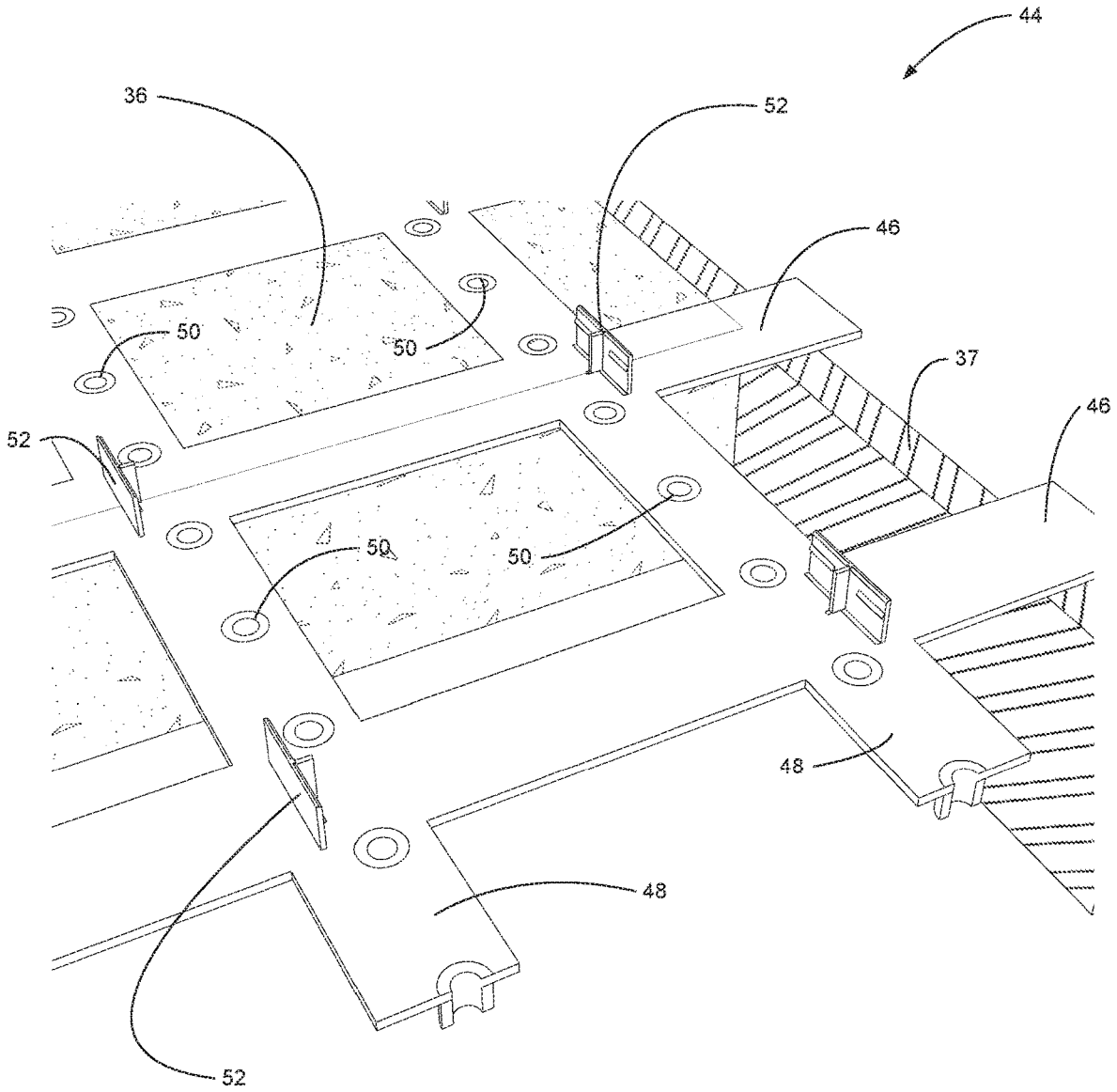
FIG. 9*c* is a detailed cutaway perspective view of the embodiment of FIG. 9.

FIG. 9 through FIG. 9*c* illustrates various view of an exemplary spacing device 44. In exemplary embodiments, the spacing device 44 may comprise a number of longitudinal members 48 and a number of transverse members 46 formed into a grid. The longitudinal members 48 may extend substantially parallel to one another. The transverse members 46 may extend substantially parallel to one another. The transverse members 46 may extend substantially perpendicular to, and intersect with, the longitudinal members 48. In exemplary embodiments, two longitudinal members 48 may extend along the base 36. A number of transverse members 46 may extend substantially perpendicular to, and across, the two longitudinal members 48, thereby forming a rail road track like pattern.

A number of apertures 50 may be located along one or more of the longitudinal members 48. In exemplary embodiments, the apertures 50 may be located at spaced intervals along each of the longitudinal members 48. The apertures 50 may each be configured to accommodate a fastener for securing the spacing device 44 to the base 36.

A number of posts 52 may be located along one or more of the longitudinal members 50. In exemplary embodiments, the posts 52 may be located at spaced intervals along each of the longitudinal members 48. The posts 52 may be located at each of the intersections of the longitudinal members 48 and the transverse members 46, though any location is contemplated.

Base shuttering 37 may be used to create the base 36. The base shuttering 37 may be comprised of panels, which may be comprised of wood, for example without limitation.

Figure 9D:
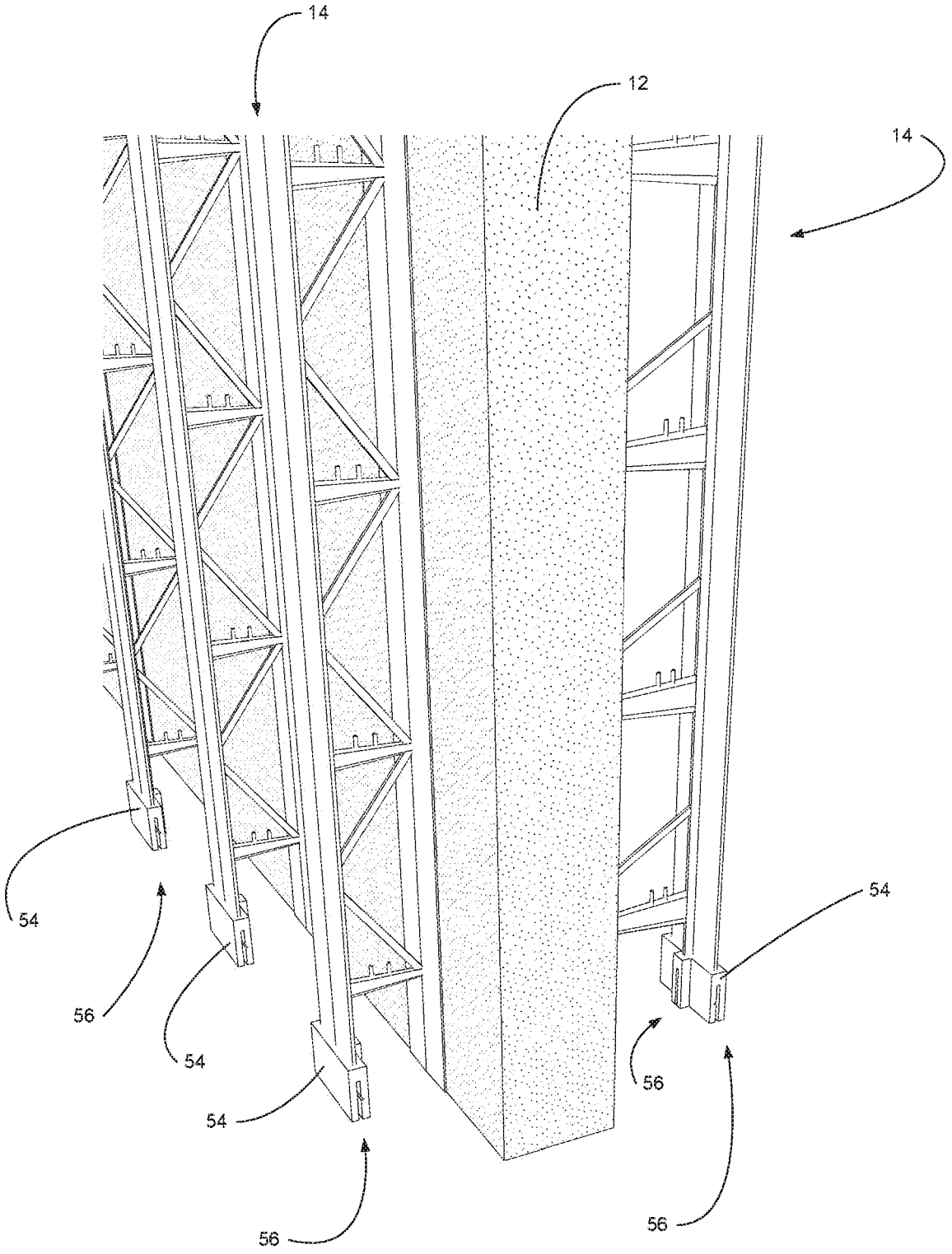
FIG. 9*d* is a side perspective view of the embodiment of FIG. 1*a* with spacing device adapters on the framework members.

FIG. 9*d* illustrates the framework member 14 with spacing device adapters 54. The spacing device adapters 54 may be configured to receive the posts 52 of the spacing device 44. The spacing device adapters 54 may comprise one or more slots 56. The slots 56 may be sized and oriented to accommodate some or all of the posts 52.

Figure 9E:
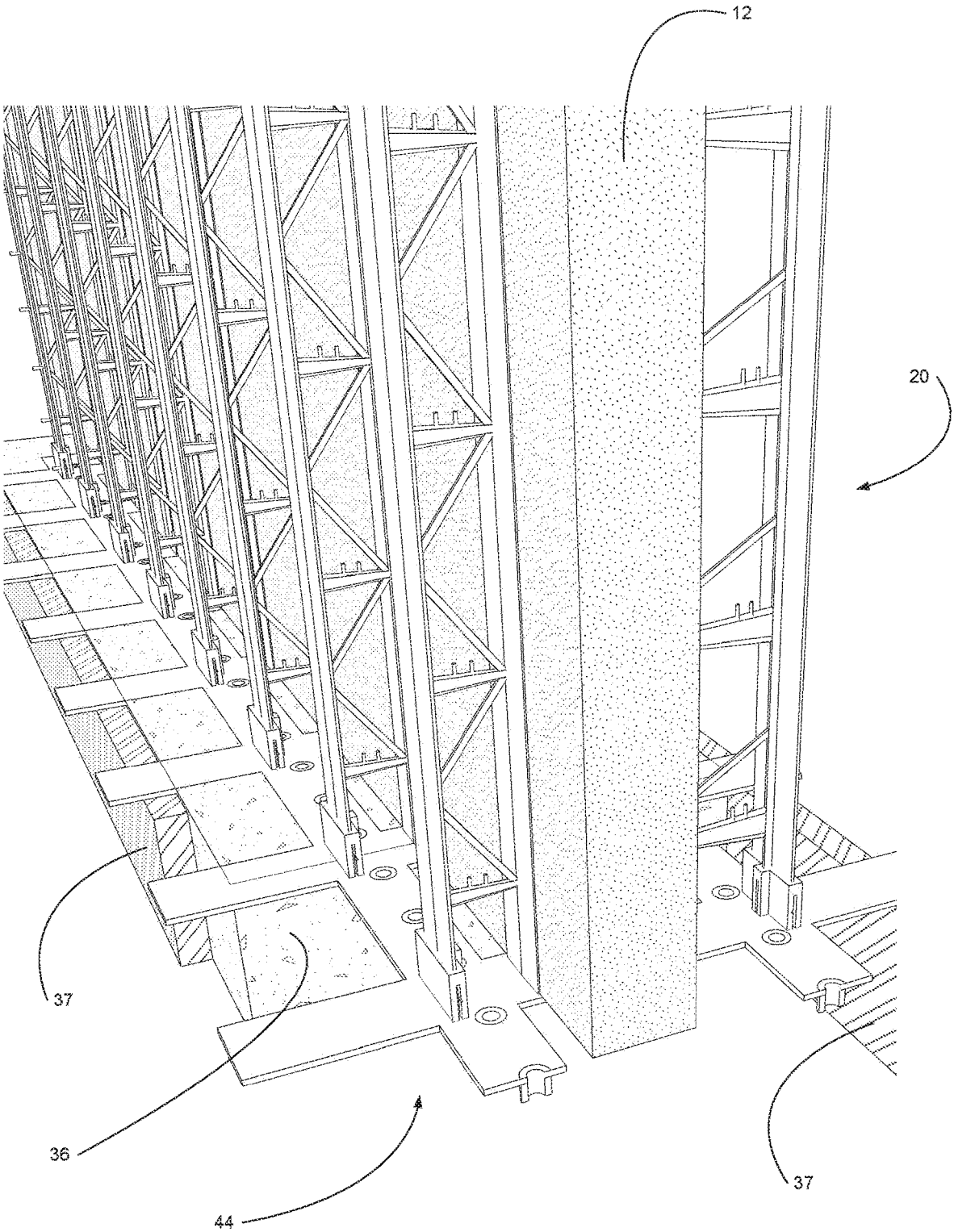
FIG. 9*e* is a side perspective view of the embodiment of FIG. 9*d* with the spacing device and foundational member of FIG. 9.

FIG. 9*e* illustrates the shuttering framework section 20 installed to the spacing device 44 on the base 36 with the insulating core 12 also installed.

In exemplary embodiments, the base 36 may be created. The base 36 may be created by grading an underlying surface, installing the base shuttering 37, pouring concrete into the space between the surface and the base shuttering 37, smoothing the concrete, and allowing the concrete to cure. The spacing device 44 may be installed to the base 36 by passing fasteners through the apertures 50 and into the base 36. Each of the framework members 14 forming a framework section 20 may be installed by securing the spacing device adapters 54 to the posts 52 in the spacing device 44. In other exemplary embodiments, the spacing device 44 may not be used and the framework members 14 may instead be spaced apart along the base 36 and secured by passing fasteners though apertures 50 in the feet 16 and into the base 36. Regardless, any number of framework sections 20 may be installed in any orientations to create a framework for some or all of a structure. Various framework sections 20 may be joined by joining members 40 and/or corner joining members 42.

Shuttering 34A and 34B may be installed on either side of the framework members 14. Material forming the insulating core 12 may be deposited within the framework structure 20. The material may be prefabricated panels of insulation. In other exemplary embodiments, liquid, foaming material may be deposited and allowed to cure. Material forming the outer wall 32A and the inner wall 32B, such as for example without limitation concrete, may be deposited within the framework structure 20. Reinforcement members 38 may be extended through the deposited materiel forming the outer wall 32A and the inner wall 32B. The reinforcement members 38 may be provided before or after the material forming the outer wall 32A and the inner wall 32B is deposited. At least some of the reinforcement members 38 may be secured within the holders 26. The material forming the outer wall 32A and the inner wall 32B may be allowed to cure. The shuttering 34A and 34B may be removed. Ornamental features, additional insulation, vapor barriers, some combination thereof, or the like, may be added.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A framework member for creating sandwich walls comprising:

an outer strongback having an inner surface;

an inner strongback, wherein an inner surface of the inner strongback faces the inner surface of the outer strongback;

an outer support member located between the outer strongback and the inner strongback; and an inner support member located between the outer strongback and the inner strongback, wherein an inner surface of the inner support member faces an inner surface of the outer support member;

a first wall gap between the outer strongback and the outer support member configured to receive concrete for forming an outer wall;

a second wall gap between the inner strongback and the inner support member configured to receive concrete for forming an inner wall;

an insulating gap between the outer support member and the inner support member configured to receive an insulating material forming an insulating core;

a first number of connectors, wherein each of the first number of connectors are spaced apart from one another and extend between the outer strongback and the outer support member;

a second number of connectors, wherein each of the second number of connectors are spaced apart from one another and extend between the inner strongback and the inner support member;

a first number of holders, each located on an upper edge of each of the first number of connectors; and a second number of holders, each located on an upper edge of each of the second number of connectors;

wherein each of the first number of holders and each of the second number of holders are configured to accommodate a reinforcement member;

wherein the outer strongback, the inner strongback, the outer support member, and the inner support member are each configured to extend vertically from a base.

2. The framework member of claim 1 wherein:

the outer strongback, the inner strongback, the outer support member, and the inner support member each extend substantially parallel to one another.

3. The framework member of claim 2 further comprising:

a number of connecting members, wherein each of the number of connecting members are spaced apart from one another and extend horizontally between the outer support member and the inner support member.

4. The framework member of claim 3 wherein:

each of the first number of connectors comprise a tapered edge; and each of the second number of connectors comprise a tapered edge.

5. The framework member of claim 4 wherein:

each of the number of connecting members are substantially aligned with one of the first number of connectors and one of the second number of connectors.

6. The framework member of claim 4 further comprising:

a first stiffening protrusion extending substantially the length of the inner surface of the outer strongback; and a second stiffening protrusion extending substantially the length of the inner surface of the inner strongback.

7. The framework member of claim 5 further comprising:

a first number of additional connectors, wherein each of the first number of additional connectors are spaced apart from one another and extend at an angle between the outer strongback and the outer support member; and a second number of additional connectors, wherein each of the second number of additional connectors are spaced apart from one another and extend at an angle between the inner strongback and the inner support member.

8. The framework member of claim 7 wherein:

each of the first number of additional connectors are connected at one end thereof to one of a corresponding one of the second number of connectors; and each of the second number of additional connectors are connected at one end thereof to one of a corresponding one of the third number of connectors.

9. The framework member of claim 1 further comprising:

a first foot located at a first end of the outer strongback for securing the outer strongback to the base; and a second foot located at a first end of the inner strongback for securing the inner strongback to the base.

10. The framework member of claim 1 further comprising:

a first number of projections extending from an outer surface of the outer strongback; and a second number of projections extending from an outer surface of the inner strongback.

11. A system for creating sandwich walls comprising:

a base;

a number of framework members, each framework member extending vertically from the base and comprising:

an outer strongback having an inner surface and an outer surface and comprising a first number of projections spaced apart along at least some of the outer surface;

an inner strongback having an inner surface and an outer surface and comprising a second number of projections spaced apart along at least some of the outer surface;

an outer support member located between the inner surface of the outer strongback and the inner surface of the inner strongback;

an inner support member located between an inner surface of the outer support member and the inner surface of the inner strongback;

an insulating gap between the outer support member and the inner support member configured to receive an insulating material forming an insulating core;

a first number of connectors, each extending between the outer strongback and the outer support member;

a second number of connectors, each extending between the outer support member and the inner support member; and a third number of connectors, each extending between the inner support member and the inner strongback;

wherein the outer strongback, the inner strongback, the outer support member, and the inner support member each extend substantially parallel to one another;

an outer wall shuttering extending from the base and having an inner surface contacting the first number of projections;

an inner wall shuttering extending from the base and having an inner surface contacting the second number of projections;

a first wall gap between the outer wall shuttering and the outer support member configured to receive a wall material for forming an outer wall;

a second wall gap between the inner wall shuttering and the inner support member configured to receive the wall material for forming an inner wall a spacing device configured to be secured to the base, wherein said spacing device comprises:

a first and second longitudinal member extending substantially parallel to one another;

a number of transverse members, each extending between and beyond the first and second longitudinal members; and a number of posts located along at least a portion of the first and second longitudinal members; and a number of spacing device adapters, each located at an end of the inner strongback or the outer strongback, wherein each of the spacing device adapters are configured to receive one of the posts.

12. The system of claim 11 wherein:

the wall material comprises concrete; and the insulating material comprises a foamed polystyrene.

13. The system of claim 12 further comprising:

a first number of horizontal reinforcement members;

a second number of horizontal reinforcement members;

a first number of holders, each located on one of the first number of connectors and configured to receive one of the first number of horizontal reinforcement members; and a second number of holders, each located on one of the third number of connectors and configured to receive one of the second number of horizontal reinforcement members.

14. The system of claim 13 further comprising:

a first number of vertical reinforcement members located within the first wall gap; and a second number of vertical reinforcement members located within the second wall gap.

15. The system of claim 11 further comprising:

a joining member located within the insulating gap and shaped as an I-beam.

16. The system of claim 11 further comprising:

a corner joining member located at least partially within the insulating gap and configured to create an angled outer wall, inner wall, and insulating core.

17. A method for creating sandwich walls comprising the steps of:

securing a number of framework members to a base, each of said framework members comprising:

an outer strongback having an inner surface;

an inner strongback, wherein an inner surface of the inner strongback faces the inner surface of the outer strongback;

an outer support member located between the outer strongback and the inner strongback; and an inner support member located between the outer strongback and the inner strongback;

securing outer wall shuttering to said base along, and spaced apart from, an outer surface of each of the outer strongbacks;

securing inner wall shuttering to said base along, and spaced apart from, an outer surface of each of the inner strongbacks;

depositing an insulating material into a first gap between the outer support member and the inner support member;

depositing a first portion of a wall material into a second gap between the outer wall shuttering and the outer support member; and depositing a second portion of the wall material into a third gap between the inner wall shuttering and the inner support member;

wherein the wall material comprises concrete.

* * * * *